US005537189A

United States Patent [19]

Imes

[11] Patent Number: 5,537,189

[45] Date of Patent: Jul. 16, 1996

[54] PRINTING APPARATUS WHICH GROUNDS PHOTORECEPTOR INDEPENDENTLY OF CRU

[75] Inventor: Edward P. Imes, Ontario, N.Y.

[73] Assignee: Xerox Corporation, Stamford, Conn.

[21] Appl. No.: 497,989

[22] Filed: Jul. 3, 1995

[51] Int. Cl.[6] ..... G03G 15/00

[52] U.S. Cl. ..... 355/210; 355/211; 361/214; 361/221

[58] Field of Search ..... 355/210, 211, 355/212, 213, 271, 219, 200; 361/214, 221

[56] References Cited

U.S. PATENT DOCUMENTS

| | | | |
|---|---|---|---|
| 3,533,692 | 10/1970 | Blanchette et al. | 355/212 |
| 3,796,488 | 3/1974 | Tanaka et al. | 355/212 |
| 4,003,651 | 1/1977 | Hashida et al. | 355/210 |
| 4,402,593 | 9/1983 | Bernard et al. | 361/221 X |
| 4,975,744 | 12/1990 | Ebata et al. | 355/211 |
| 5,010,441 | 4/1991 | Fox et al. | 361/221 |
| 5,243,384 | 9/1993 | Everdyke et al. | 355/212 |
| 5,270,106 | 12/1993 | Orlowski et al. | 355/219 X |
| 5,307,117 | 4/1994 | Harlan | 355/200 |
| 5,354,607 | 10/1994 | Swift et al. | 428/294 |
| 5,400,208 | 3/1995 | Pazda et al. | 361/221 |
| 5,402,207 | 3/1995 | Michlin | 355/200 |
| 5,410,386 | 4/1995 | Swift et al. | 355/200 |
| 5,436,696 | 7/1995 | Orlowski et al. | 355/200 |

FOREIGN PATENT DOCUMENTS

| | | |
|---|---|---|
| 61-254962 | 11/1986 | Japan . |
| 61-254963 | 11/1986 | Japan . |
| 3-265881 | 11/1991 | Japan . |
| 5-289427 | 11/1993 | Japan . |

*Primary Examiner*—Matthew S. Smith
*Attorney, Agent, or Firm*—Zosan S. Soong

[57] ABSTRACT

There is disclosed an electrostatographic printing apparatus having (a) a detachable imaging module including a housing and a photosensitive member, wherein the photosensitive member is partially enclosed within the housing, and wherein the photosensitive member has an outer surface which includes an electrically conductive portion; (b) an electrically grounded component free of attachment to the module; and (c) an electrically conductive part, free of attachment to the module, in contact with both the grounded component and the conductive portion on the outer surface of the photosensitive member, thereby establishing grounding of the photosensitive member, and wherein upon removal of the imaging module the part remains in contact with the grounded component and upon insertion of a new detachable imaging module which has a new photosensitive member having an outer surface that includes an electrically conductive portion, the part contacts the electrically conductive portion on the outer surface of the new photosensitive member, thereby establishing grounding of the new photosensitive member.

10 Claims, 2 Drawing Sheets

PRINTING APPARATUS WHICH GROUNDS PHOTORECEPTOR INDEPENDENTLY OF CRU

This invention relates to an electrostatographic printing apparatus where the grounding of the photoreceptor is accomplished independently of the customer replaceable unit containing the photoreceptor (also referred herein as a photosensitive member or a photoconductive member). The phrase printing apparatus includes both printing and copying devices.

Recently, electrophotographic printing machines have been developed which use one or more replaceable subassemblies called customer replaceable units (CRU). One typical CRU contains the machine photoreceptor and the necessary supporting hardware therefor assembled in a single unit designed for insertion and removal into and out of the machine by the user. When the CRU (also referred herein as module) is no longer operational, the old CRU is removed and a new one installed. A conventional grounding method is through a metal strip mechanically attached to one of the non-metallic flanges which cap the ends of the photoreceptor. One end of the metal strip contacts the inside of the photoreceptor substrate while the other end of the metal strip contacts the center metal shaft which rotates the photoreceptor, thus completing the ground circuit. Any deformation of the metal strip during assembly, however, can result in loss of ground, either permanently or intermittently. Repair of the metal strip within the photoreceptor is difficult since the end flanges are glued in. The present invention addresses the above problem by grounding the photoreceptor independently of the CRU. The term independently means that components used to establish grounding of the photoreceptor are not fastened to the imaging CRU (containing the photoreceptor) and that preferably insertion of a new imaging CRU into the printing apparatus reestablishes grounding of the photoreceptor.

Conventional consumer replaceable units are disclosed in Ebata et al., U.S. Pat. No. 4,975,744; Harlan, U.S. Pat. No. 5,307,117; and Everdyke et al., U.S. Pat. No. 5,243,384, the disclosures of which are totally incorporated by reference. Michlin, U.S. Pat. No. 5,402,207, discloses a long-life and improved photoreceptor drum gear. Swift et al., U.S. Pat. No. 5,354,607, discloses fibrillated pultruded electronic components and static eliminator devices.

In the Xerox 5090 duplicator, the organic photoreceptor is in the shape of a flexible belt and is grounded via an electrically conductive portion (i.e., a partially exposed ground plane) on the outer surface of the photoreceptor. An electrically grounded carbon fiber brush contacts the electrically conductive portion of the photoreceptor to complete the ground circuit. However, the photoreceptor of the Xerox 5090 duplicator is not part of a customer replaceable unit. Consequently, replacement of the 5090 photoreceptor is more involved and requires the services of a technician.

SUMMARY OF THE INVENTION

The invention is accomplished in embodiments by providing an electrostatographic printing apparatus comprising:

(a) a detachable imaging module including a housing and a photosensitive member, wherein the photosensitive member is partially enclosed within the housing, and wherein the photosensitive member has an outer surface which includes an electrically conductive portion;

(b) an electrically grounded component free of attachment to the module; and (c) an electrically conductive part, free of attachment to the module, in contact with both the grounded component and the conductive portion on the outer surface of the photosensitive member, thereby establishing grounding of the photosensitive member, and wherein upon removal of the imaging module the part remains in contact with the grounded component and upon insertion of a new detachable imaging module which comprises a new photosensitive member having an outer surface that includes an electrically conductive portion, the part contacts the electrically conductive portion on the outer surface of the new photosensitive member, thereby establishing grounding of the new photosensitive member.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in the Figures refers to the same or similar feature.

DETAILED DESCRIPTION

Figure 1:
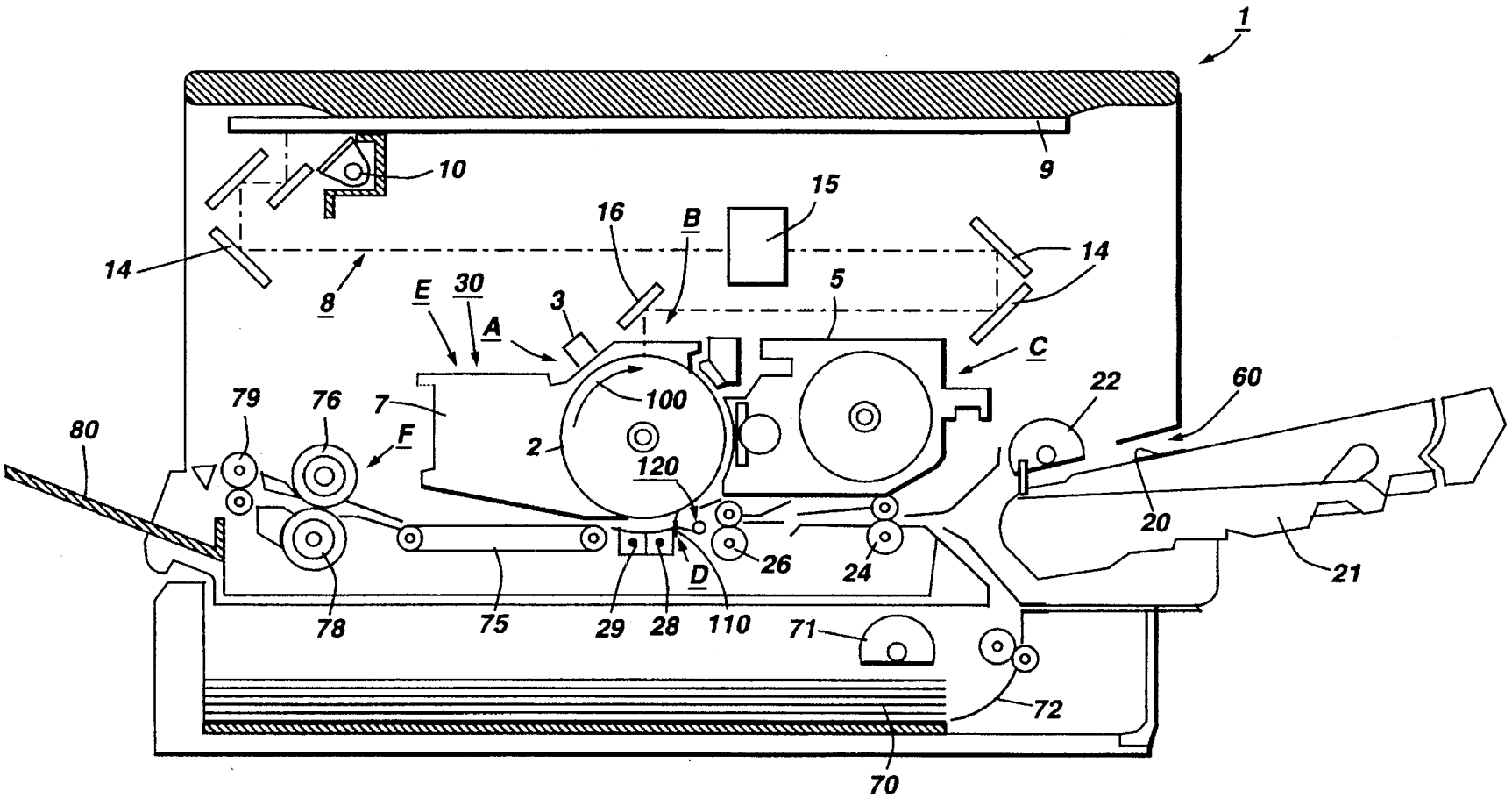
FIG. 1 is a schematic view of an electrophotographic printing apparatus wherein the photosensitive member is grounded independently of the imaging CRU.

Referring first to FIG. 1, the electrophotographic copying machine 1 includes a photosensitive member 2 (also referred herein as drum 2) which is rotated in the direction indicated by the arrow 100 so as to pass sequentially through a series of xerographic processing stations; a charge station A, an imaging station B, a developer station C, a transfer station D and a cleaning station E. The drum 2, corona generating device 3, and cleaning housing 7, form a unit that is produced as a single module known as a customer replaceable unit (CRU) generally referred to as reference numeral 30, which is detachably mounted to the apparatus main body and is replaceable by the customer.

Initially drum 2 rotates a portion of the photoconductive surface to a charging station A. Charging station A employs a corona generating device indicated generally by the reference numeral 3, to charge the photoconductive surface to a relatively high, substantially uniform potential.

Thereafter, drum 2 rotates the charged portion of the photoconductive surface to exposure station B. Exposure station B includes an exposure mechanism indicated generally by the reference numeral 8 having a stationary, transparent platen 9, such as a glass plate or like for supporting an original document thereon. Lamp 10 illuminates the original document. Scanning of the original document is achieved by translating the lamp in a time relationship with the movement of drum 2 so as to create incremental light images which are reflected upon a fixed mirror 16 via mirrors 14 and an optical lens 15 onto the charged portion of the photosensitive drum 2. Irradiation of the charged portion of the photoconductive surface of the drum 2 records an electrostatic image corresponding to the informational areas contained within the original document. Obviously, electronic imaging of the page information could be facilitated by a printing apparatus utilizing electrical imaging signals. The printing apparatus can be a digital copier including an input device, such as a raster input scanner (RIS) and a printer output device, such as a raster output scanner (ROS), or, a printer utilizing a printer output device such as a ROS.

Subsequently, the electrostatic latent image is developed at developer station C. At the developer station, developer material from a developer housing 5 is caused to flow in contact with the surface of the drum 2. The developer material in the form of charged toner particles, is attracted to the image area of the drum 2 to form a visible toner image. The surface of the moving drum 2 then transports the toner image to transfer station D. Cut sheets of support material 20 are fed from the input tray 21 by sheet feeder 22 to the transfer station D via delivery rollers 24 and timing rollers 26 in synchronous relationship with the image on the surface of the drum 2. The backside of the sheet is sprayed with ions discharged from a transfer corotron 28 inducing on the sheet a charge having a polarity and magnitude sufficient to attract the toner material from the surface of the drum 2 to the sheet. The induced charge also electrostatically tacks the sheet to the drum 2. Subsequently, a second transfer corotron 29 induces an opposite charge on the sheet to facilitate the removal of the sheet from the surface of the drum 2. Also, to facilitate removal of the sheet, a stripper finger may be utilized to move between the drum 2 and the sheet of support material 20 to lift the sheet from the surface of the drum 2. A sheet of support material may either be fed from the manual input 60, from the input tray 21, or from an auxiliary second input tray 70 by feeder 71 along path 72 to the aforementioned delivery rollers 24 and timing rollers 26.

The surface of the drum 2 continues along its rotational path passing cleaning station E, whereat the residual toner remaining on the surface of the drum 2 is removed prior to the charging thereof at charging station A. At the cleaning station E, the residual toner is mechanically cleaned from the surface of the drum 2, by means of a blade or the like. The toner is then collected within the cleaning housing 7. The residual toner may be collected and transported back to the developer housing 5 by suitable means, such as a conveyor moving in an endless loop through a tube. The collected residual toner can then be deposited in the developer mix within the developer housing 5 so that it can be reused in the developing process.

Following transfer and stripping, the sheet is transferred along transfer belt 75 to fusing station F. The fusing station F comprises an upper fuser roll 76 and a lower fuser roll 78 mounted in operative relation to each other and arranged to interact so as to support the sheet of support material in a pressure driving contact therebetween. At least one of the two rolls is heated (as shown, the upper roll 76), with the other roll typically being a simple pressure roller (as shown, the lower roll 78). As the heated roll 76 is rotated, the heated surface thereof is pressed into contact with the image face of the sheet. Mechanical and heat energy is transferred from the roll surface to the sheet of support material permanently bonding the toner particles thereto. Upon leaving the fusing station F, the sheet having the image fixed thereto is discharged into a copy tray 80 by discharge rollers 79.

After producing the prescribed number of copies, the CRU 30 is replaced by the customer.

In FIG. 1, an electrically conductive part 110, which may be in the form of for example a brush or a metal tab, is in electrical contact with and is coupled to a grounded component free of attachment to CRU 30 such as the grounded transfer corotron 28, which is a type of charge generating apparatus. The conductive part 110 contacts the photosensitive drum 2 at an electrically conductive portion on the outer surface of the drum 2. Thus, grounding of the photosensitive drum 2 is established in this embodiment via the conductive part and the transfer corotron 28. As shown in FIG. 1, the corotron 28 and corotron 29 are joined together into a single unit. An example of a single unit dual corotron is found for example in the Xerox 5012 copier. However, in other embodiments, corotron 28 and corotron 29 may be separate devices.

Figure 2:
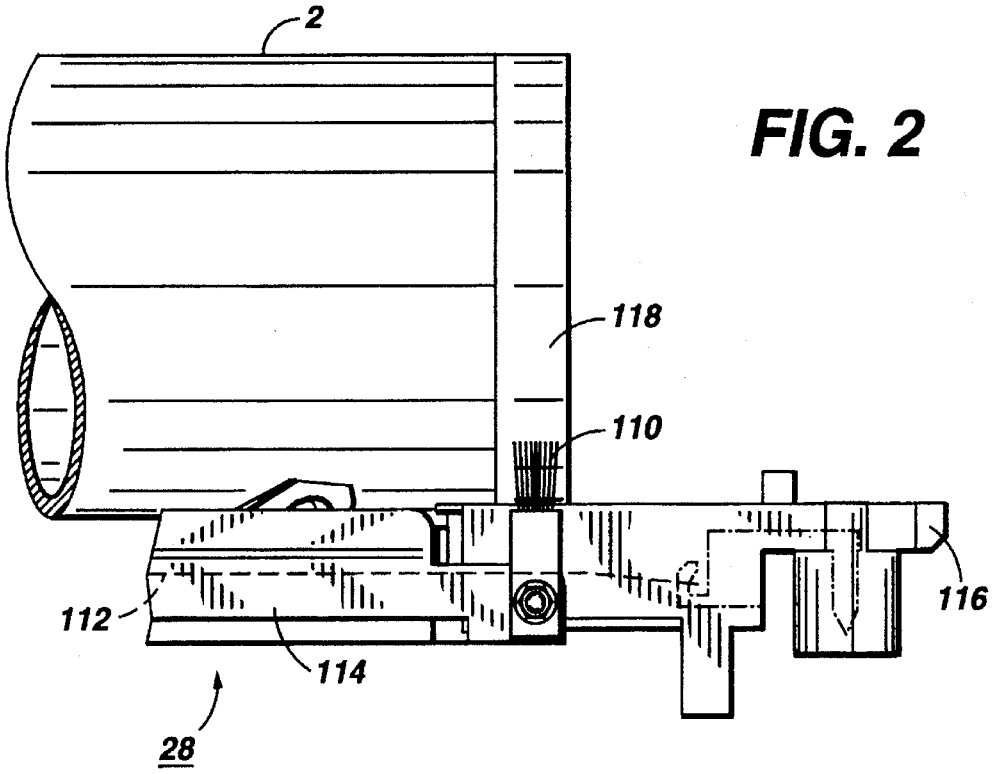
FIG. 2 is a schematic view of the electrically conductive part and the grounded component (in the configuration of a transfer corotron 28) as viewed from the paper input tray 21 side of the printing apparatus of FIG. 1.

FIG. 2 illustrates the positioning of the conductive part 110, which is in the form of a brush, on transfer corotron 28. Corotron 28 includes a wire 112, a metal shield 114, and a plastic insulating block 116 at one end. The conductive part 110 is coupled to the shield 114 via for example a fastener like a screw at a spot adjacent to the insulating block 116, where the spot is selected to allow contact of the part 110 and the electrically conductive portion 118 on the outer surface of the drum 2. The shield 114 of the corotron 28 is g rounded via contact of the shield 114 to a grounding plate located beneath the corotron 28 in the base of the copying machine. In embodiments of the invention, a second electrically conductive part optionally may be positioned at the other end of the shield of the corotron 28 to contact another electrically conductive portion on the outer surface of the photosensitive drum 2 to ensure grounding of the photosensitive drum.

Figure 3:
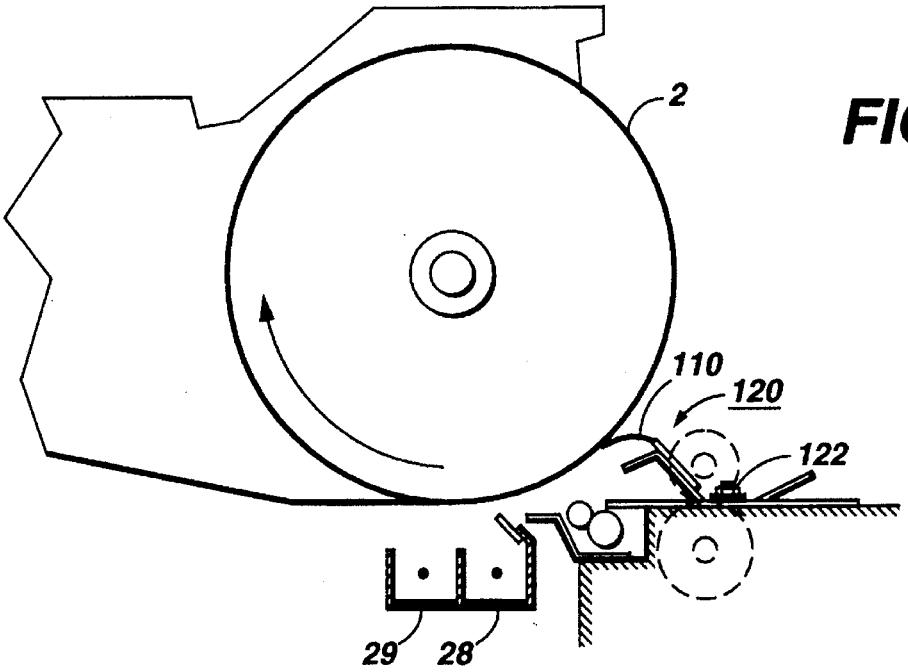
FIG. 3 schematic view of an alternate placement of the electrically conductive part in the printing apparatus of FIG. 1.

FIG. 3 illustrates placement of the electrically conductive part 110 on an alternative grounded component involving a paper guide structure 120 such as a left chute paper guide found for example in the Xerox 5012 copier. (See FIG. 1 for approximate location of the paper guide structure 120 in the representative printing apparatus). The paper guide structure 120 is free of attachment to the CRU 30. The conductive part 110, which may be in the form of for example a brush or a metal tab, is in electrical contact with and is coupled via a fastener like a screw to the paper guide structure 120. The position of the conductive part 110 on the paper guide structure is selected so that the conductive part contacts the electrically conductive portion on the outer surface of the photosensitive member 2. A wire from the conductive part 110 to the attachment screw 122 completes the grounding of the photosensitive member 2 where the paper guide structure 120 is grounded via a grounding plate and/or wire conductor electrically connected back to the power supply ground.

As evident from the present discussion, upon removal of the CRU for servicing or replacement, the electrically conductive part 110 stays with the printing apparatus and remains in contact with the grounded component. Upon insertion of a new CRU, the electrically conductive part contacts the electrically conductive portion on the outer surface of the new photosensitive member, thereby establishing grounding of the new photosensitive member. The conductive part contacts the photosensitive member, but the conductive part is not coupled to the CRU containing the photosensitive member.

The photosensitive member may be in the shape of a drum or a flexible, endless belt. The photosensitive member typically comprises a substrate and one or more coatings. The substrate can be made of any suitable material such as aluminum, nickel, zinc, chromium, conductive paper, stainless steel, cadmium, titanium, metal oxides, polyesters such as MYLAR®, and the like. The substrate can be formed as one layer or as a plurality of layers, for example as an electrically conductive layer coated over an insulating layer. The coating on the substrate includes, as a photoconductive material, one or a plurality of layers of selenium, metal alloys, and/or organic resins carrying photoconductive materials. Organic photoconductor coatings are preferred. Such coatings include a photoconductive material such as pigments including dibromoanthanthrone, metal-free and metal phthalocyanines, halogenated metal phthalocyanines, perylenes, and azo pigments, carried in a suitable organic binder resin. Examples of useful organic binder resins include polycarbonates, acrylate polymers, vinyl polymers, cellulose polymers, polysiloxanes, polyamides, polyurethanes, polyesters, and block, random or alternating copolymers thereof. The electrically conductive portion on the outer surface of the photosensitive member may be an uncoated region of the photosensitive member, thereby exposing the underlying electrically conductive substrate surface. Preferably, both end regions of the photosensitive member are uncoated to reveal an electrically conductive substrate surface.

The electrically conductive part preferably comprises conductive fibers in the form of for example a brush. A brush similar to the grounding brush employed in the Xerox 1090 copier may be used. Suitable fibers for the conductive brush are disclosed in Swift et al., U.S. Pat. No. 5,354,607, the disclosure of which is hereby totally incorporated by reference. The conductive fibers may be metallic or nonmetallic and may have a DC volume resistivity of from about $1\times10^{-5}$ to about $1\times10^{10}$ ohm-cm to minimize resistance losses. The individual conductive fibers may be generally circular in cross section and have a diameter generally in the order of from about 4 to about 50 microns. The fibers are typically flexible and include for example carbon and carbon/graphite fibers. Preferred fibers are obtained from the controlled heat treatment processing to yield complete or partial carbonization of polyacrylonitrile precursor fibers. The carbon fibers from polyacrylonitrile precursor fibers are commercially produced by the Stackpole Company, and Celion Carbon Fibers, Inc., a division of BASF. Preferably, the conductive part does not significantly abrade the surface of the rotating photosensitive member.

There may be several advantages associated with grounding the photosensitive member independently of the CRU as disclosed herein. First, it may be possible to eliminate the conventional grounding strip and perhaps the metal shaft disposed within the CRU, thereby yielding a cost savings on materials during manufacture of the CRU. Second, it may be possible to retrofit in the field those printing apparatus where the CRU is experiencing a grounding circuit problem. Third, the present invention may reduce costs associated with fixing CRU grounding problems during manufacture of the CRU.

Other modifications of the present invention may occur to those skilled in the art based upon a reading of the present disclosure and these modifications are intended to be included within the scope of the present invention.

I claim:

1. An electrostatographic printing apparatus comprising:

(a) a detachable imaging module including a housing and a photosensitive member, wherein the photosensitive member is partially enclosed within the housing, and wherein the photosensitive member has an outer surface which includes an electrically conductive portion;

(b) an electrically grounded component free of attachment to the module; and (c) an electrically conductive part, free of attachment to the module, in contact with both the grounded component and the conductive portion on the outer surface of the photosensitive member, thereby establishing grounding of the photosensitive member, and wherein upon removal of the imaging module the part remains in contact with the grounded component and upon insertion of a new detachable imaging module which comprises a new photosensitive member having an outer surface that includes an electrically conductive portion, the part contacts the electrically conductive portion on the outer surface of the new photosensitive member, thereby establishing grounding of the new photosensitive member.

2. The apparatus of claim 1, wherein the electrically conductive portion on the outer surface of the photosensitive member is an uncoated region of the photosensitive member.

3. The apparatus of claim 1, wherein the photosensitive member has the shape of a drum.

4. The apparatus of claim 1, wherein the photosensitive member is adapted to rotate.

5. The apparatus of claim 1, wherein the electrically grounded component is a charge generating apparatus.

6. The apparatus of claim 1, wherein the electrically grounded component is a corotron apparatus including a grounded shield.

7. The apparatus of claim 1, wherein the electrically grounded component is a paper guide structure.

8. The apparatus of claim 1, wherein the part comprises carbon fibers.

9. The apparatus of claim 1, wherein the part is a brush.

10. The apparatus of claim 1, wherein the part is coupled to the electrically grounded component.

* * * * *